US008556307B1

(12) United States Patent
Schaffhausen

(10) Patent No.: US 8,556,307 B1
(45) Date of Patent: Oct. 15, 2013

(54) ADJUSTABLE SINGLE HUNG, DOUBLE HUNG, SLIDING WINDOW, SLIDING GLASS DOOR LOCK

(76) Inventor: John Michael Schaffhausen, Lakeville, MN (US)

( * ) Notice: Subject to any disclaimer, the term of this patent is extended or adjusted under 35 U.S.C. 154(b) by 66 days.

(21) Appl. No.: 13/034,664

(22) Filed: Apr. 15, 2011

Related U.S. Application Data

(60) Provisional application No. 61/224,163, filed on Mar. 1, 2010.

(51) Int. Cl.
*E05C 19/06* (2006.01)
*E05C 17/04* (2006.01)

(52) U.S. Cl.
USPC 292/259 R; 292/262; 292/338; 292/DIG. 47; 292/DIG. 60; 49/449

(58) Field of Classification Search
USPC ..... 292/259 R, 262, 338, 339, DIG. 47, 292/DIG. 60; 16/82; 49/449
See application file for complete search history.

(56) References Cited

U.S. PATENT DOCUMENTS

| | | | | | |
|---|---|---|---|---|---|
| 804,994 | A | * | 11/1905 | Andrews | 292/219 |
| 1,464,345 | A | * | 8/1923 | Tomford | 292/276 |
| 1,580,611 | A | | 4/1926 | Kirkpatrick | |
| 1,601,524 | A | * | 9/1926 | Gibbons | 292/305 |
| 1,635,448 | A | * | 7/1927 | Williams | 292/338 |
| 1,811,681 | A | * | 6/1931 | Bildstein | 292/262 |
| 2,912,268 | A | | 11/1959 | Markovich | |
| 3,136,290 | A | * | 6/1964 | Bailey et al. | 116/67 R |
| 3,600,026 | A | * | 8/1971 | Savio et al. | 292/276 |
| 3,606,421 | A | * | 9/1971 | Reichenbach | 292/1 |
| 3,677,592 | A | * | 7/1972 | Navara | 292/288 |
| 3,698,754 | A | | 10/1972 | Means | |
| 4,005,889 | A | | 2/1977 | Patrick | |
| 4,152,018 | A | | 5/1979 | Cantrell | |
| 4,295,676 | A | * | 10/1981 | Smith | 292/262 |
| 4,314,721 | A | * | 2/1982 | Clark | 292/262 |
| 4,368,906 | A | | 1/1983 | Briggs | |
| 4,405,166 | A | * | 9/1983 | Lovis | 292/305 |
| 4,456,291 | A | * | 6/1984 | Brogie | 292/338 |
| 4,461,502 | A | * | 7/1984 | Burgess | 292/262 |
| 4,790,582 | A | | 12/1988 | Keast | |
| 4,792,169 | A | * | 12/1988 | Petry | 292/305 |
| 4,846,514 | A | * | 7/1989 | Flynn | 292/268 |
| 4,927,198 | A | * | 5/1990 | Fennell et al. | 292/306 |
| 5,120,093 | A | * | 6/1992 | Carney | 292/60 |
| 5,217,267 | A | | 6/1993 | Yagi | |
| 5,431,461 | A | * | 7/1995 | Andersen et al. | 292/259 R |
| 5,437,486 | A | | 8/1995 | Hoffman | |
| 5,620,213 | A | | 4/1997 | Ellis | |
| 5,676,410 | A | * | 10/1997 | Angerbrandt | 292/338 |

(Continued)

FOREIGN PATENT DOCUMENTS

| | | | | |
|---|---|---|---|---|
| DE | 3936203 | A1 * | 5/1991 | E05C 19/18 |
| DE | 4237061 | A1 * | 1/1994 | E05C 19/00 |

*Primary Examiner* — Carlos Lugo

(57) ABSTRACT

This invention provides an easily removable locking mechanism used on single hung, double hung, sliding window and sliding doors that will lock these items at various intervals. Two mounting bases are provided and designed to be interchangeable with each end of the locking mechanism and to provide ease of removal/installation of the locking mechanism in case of emergencies. The locking mechanism is comprised of two telescoping tubes with a permanent interlocking pin to hold the telescoping tubes at various intervals.

4 Claims, 4 Drawing Sheets

(56) References Cited

U.S. PATENT DOCUMENTS

| | | | |
|---|---|---|---|
| 5,778,602 | A | 7/1998 | Johnson et al. |
| 5,881,498 | A | 3/1999 | Goggin et al. |
| 5,901,499 | A | 5/1999 | Delaske et al. |
| 6,778,086 | B2 | 8/2004 | Morrone et al. |
| 6,925,758 | B2 | 8/2005 | Pettit |
| D554,472 | S | 11/2007 | Freeman |
| 7,591,494 | B2 | 9/2009 | Mitchell |
| 2002/0144465 | A1 | 10/2002 | Chang |
| 2007/0289220 | A1 | 12/2007 | Vilhauer |
| 2008/0129054 | A1 | 6/2008 | Tremble et al. |

* cited by examiner

ADJUSTABLE SINGLE HUNG, DOUBLE HUNG, SLIDING WINDOW, SLIDING GLASS DOOR LOCK

I am claiming priority to my earlier filed provisional patent 61/224,163 filed Mar. 1, 2010

References Cited:
U.S. Pat. Documents

| | | | |
|---|---|---|---|
| 7,591,494 B2 | September 2009 | Mitchell | 292/336 |
| 0,129,054 A1 | June 2008 | Tremble et al. | 292/33; 292/138; 292/177 |
| 0,289,220 A1 | December 2007 | Vilhauer | 049/449 |
| D554,472 S | November 2007 | Freeman | D8/339 |
| 6,925,758 B2 | August 2005 | Pettit | 049/460 |
| 6,778,086 B2 | August 2004 | Morrone et al. | 340/546 |
| 0,144,465 A1 | October 2002 | Chang | 049/449 |
| 5,901,499 | May 1999 | Delaske et al. | 049/183 |
| 5,881,498 | March 1999 | Goggin et al. | 049/192 |
| 5,778,602 | July 1998 | Johnson et al. | 049/449 |
| 5,620,213 | April 1997 | Ellis | 292/210 |
| 5,437,486 | August 1995 | Hoffman | 292/339 |
| 5,217,267 | June 1993 | Yogi | 292/338X |
| 4,790,582 | December 1988 | Keast | 292/288 |
| 4,368,906 | January 1983 | Briggs | 292/305 |
| 4,152,018 | May 1979 | Cantrell | 292/305 |
| 4,005,889 | February 1977 | Patrick | 292/262 |
| 3,698,754 | October 1972 | Means | 292/262 |
| 2,912,268 | November 1959 | Markovich | 292/262 |
| 1,580,611 | April 1926 | Kirkpatrick | |

BACKGROUND OF THE INVENTION

Single hung, double hung, sliding windows, and sliding glass doors are made to only lock in a closed position. This does not protect the user from intruders with a partially open window, nor does it prevent accidental closures that may cause harm to small children. Previous inventions Hoffman, U.S. Pat. No. 5,437,486 (1995), Savio, et al., U.S. Pat. No. 3,512,821 (1970), Means U.S. Pat. No. 3,698,754 (1972) and Yogi U.S. Pat. No. 5,217,267 (1973), provide the same security but are not designed for ease of use nor are they easily uninstalled to provide a quick escape in the event of an emergency. Previous inventions utilize rivets or bolts and nuts to secure the locking mechanism to a plate attached to the window frame and window base. This will require tools to remove the bar from its installed position, requiring time to locate tools and more time to remove the mechanism from the window. In addition, the previous inventions require the users to squeeze metal buttons to adjust the window opening, which creates an opportunity for the user to pinch fingers and thumbs while adjusting the lock. A design flaw with Hoffman, U.S. Pat. No. 5,437,486 (1995) indicates that the user can push the button, 36, rotating the upper pole 38 and pull down into lower tube 34, while laying the window lock 10 to either the right or left. However, pole 38 is attached to a base with a rivet or bolt which prevents the pole from being rotated. This design also indicates that the pole 38 must be separated from tube 34 every time the user wants to close the window. This leaves pole 38 hanging from the upper plate, which prevents the user from opening the window fully unless pole 38 is unbolted or held to one side while opening the window or door. This will also require the user to reinstall pole 38 into tube 34 every time the user wants to use the lock.

SUMMARY OF THE INVENTION

This invention provides an easily removable locking mechanism used on single hung, double hung, sliding window and sliding doors that will lock these items at various intervals. Two mounting bases are provided and designed to be interchangeable with each end of the locking mechanism and to provide ease of removal/installation of the locking mechanism in case of emergencies. The locking mechanism is comprised of two telescoping tubes with a permanent interlocking pin to hold the telescoping tubes at various intervals.

THE DRAWINGS

DETAILED DESCRIPTION

Figure 1:
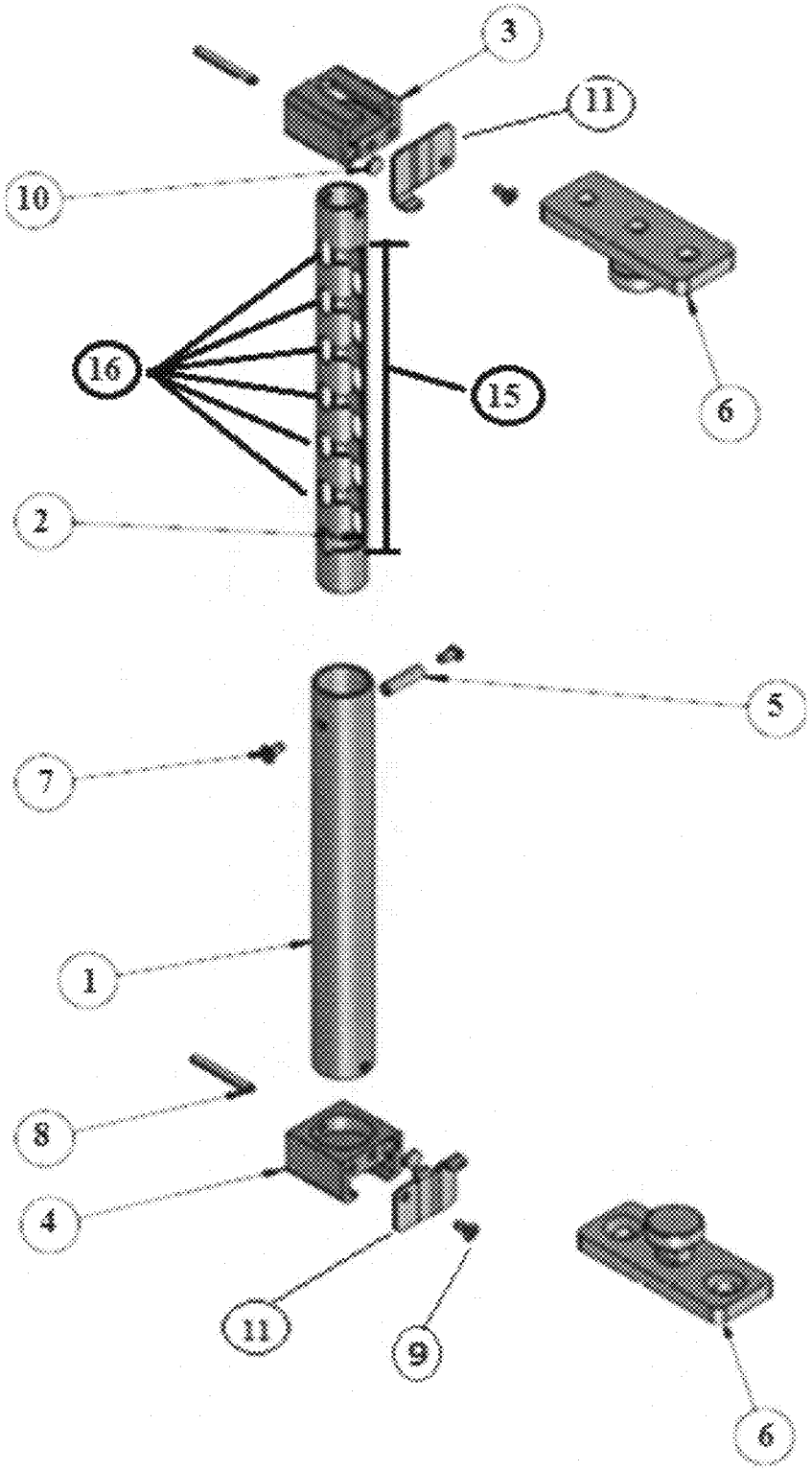
FIG. 1 is an exploded view of the window locking device.
Figure 2:
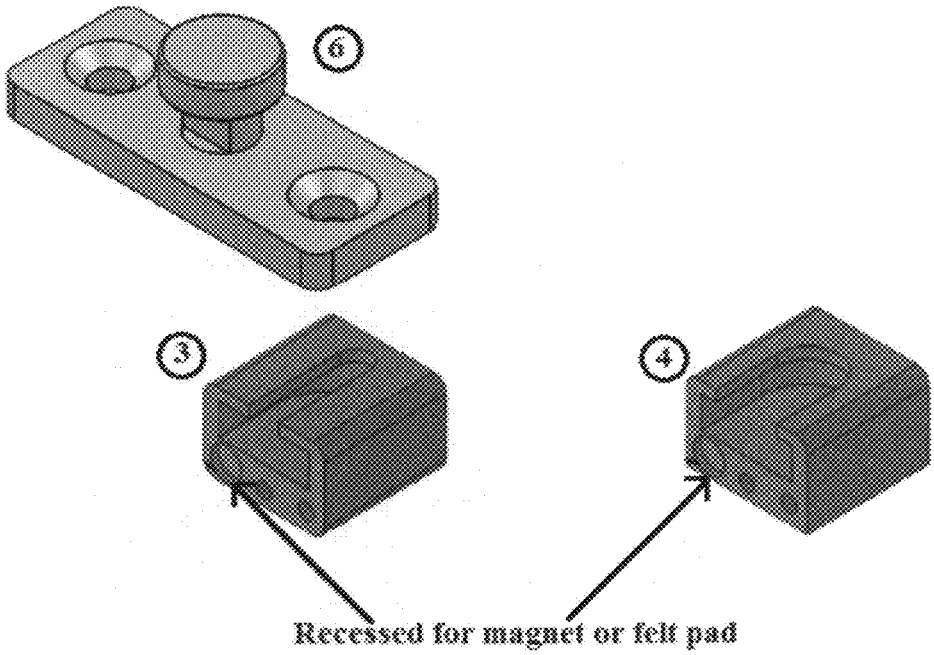
FIG. 2 is a detailed drawing of the two different types of connectors (3 & 4) and a base (6).
Figure 3:
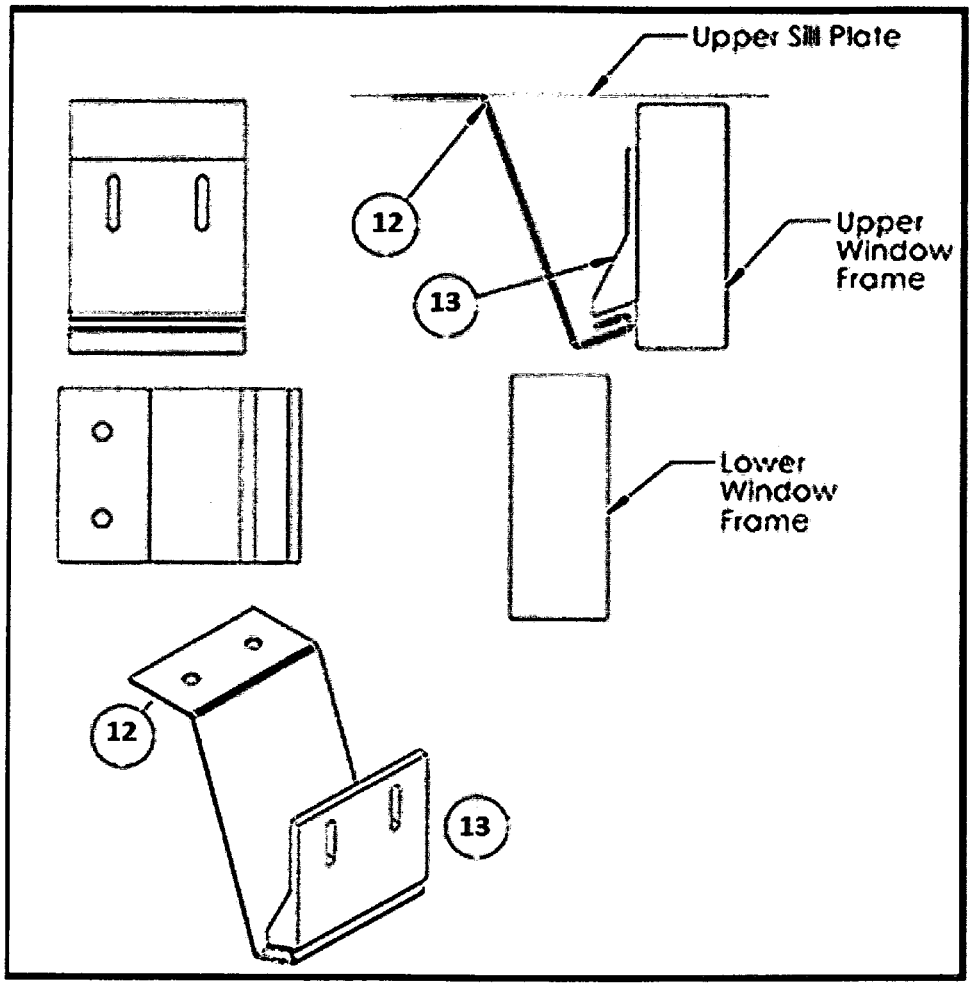
FIG. 3 is a drawing of the secondary lock.

For convenience, identification tags (numbers) are used to identify the components of the lock as referred to throughout the document.

1. Outer Tube
2. Inner Tube
3. Non-rotating tube connector
4. Rotating tube connector
5. Slot selection compression tube
6. Mounting base
7. Rivet to hold slot selection compression tube (5) in place
8. Connector and Tube compression pin
9. Rivet to allow door (11) to rotate open and close
10. Magnet or felt pad to hold door in a closed position
11. Door
12. Secondary window latch plate
13. Secondary window latch base
14. Full assembly of the lock
15. Inner tube channel
16. "T" shaped locking slot
17. Inner window frame
18. Upper Sill Plate
19. Location of a secondary window latch plate (12) on a window frame
20. Location of a secondary window latch base (13) on a secondary window
21. Inner window
22. Outer window
23. Outer window frame This window/door locking mechanism is designed to be easily and completely removed from the window/door for quick escapes and does not require the user to pinch buttons or unbolt fasteners. The base (6) is attached the windowsill (18) inside the channel of the inner window and on the window frame (17) of the inner window. Pin (8) in conjunction with the narrow slot on connector (3) is used to secure the connector (3) to the inner tube (2) and prevents the inner tube from rotating once installed on the base (6). This locking mechanism is design to allow the outer tube (1) and pin (5) secured to the outer tube (1), to rest in the locking slot-like openings of the inner tube (2). The outer tube and connector (1 & 4) will swivel on the base plate (6) allowing the user to rotate the outer tube's (1) attached pin (5) into the elongated channel in inner tube (2), thus allowing for adjustments in the window opening height/width or closing the window. The rotating doors (11) on connectors (3 & 4) are used to lock the connectors (3 & 4) to the base (6). To remove the lock from the base (6), open each door (11) on the connectors (3 & 4) and slide the connectors (3 & 4) off the base (6). A magnet or stiff felt pad (10) is used to hold the door in place if the connector (3 or 4) is inverted; this magnet or stiff felt pad is also used to hold the door (11) in place preventing the lock from vibrating off during the opening and closing motions. The door (11) may be placed into a closed/open position by use of a swivel, hinge, or sliding motion.

The design of the "T" shape locking slot (16) provides a resting place for the locking pin (5) once the locking pin is in the "T" shape locking slot (16). This prevents the locking pin (5) from moving out of the "T" shaped locking slot (16) due to vibration. The weight of the inner window (21) holds the locking pin (5) in one of the upper lip of the "T" shape locking slot (16).

The outer window on a double hung window or sliding window is locked in place with a separate mechanism. Flat metal spring (12) is attached to the windowsill (19) and latch (13) is attached to the frame of the outer window (20). The flat metal spring and latch (20 & 21) prevent the outer window on a double hung or sliding window from opening, thus allowing access to the window locking mechanism from the outside. However, this separate mechanism's metal spring (12) may be incorporated or attached to the locking bar mechanism's base (6) at location B.

The outer slope of the secondary window latch base (13) pushes the secondary window latch plate (12) away from the window allowing the outer window (22) to be closed without manually applying pressure to the secondary window latch plate (12). The inner slope of the secondary window latch base (13) matches the slope of secondary window latch plate (12) preventing the outer window (22) from opening unless the secondary window latch plate (12) is pulled away from the outer window (22). The material for all items may consist of metal, wood, plastic, fiberglass or any combination thereof.

Figure 4:
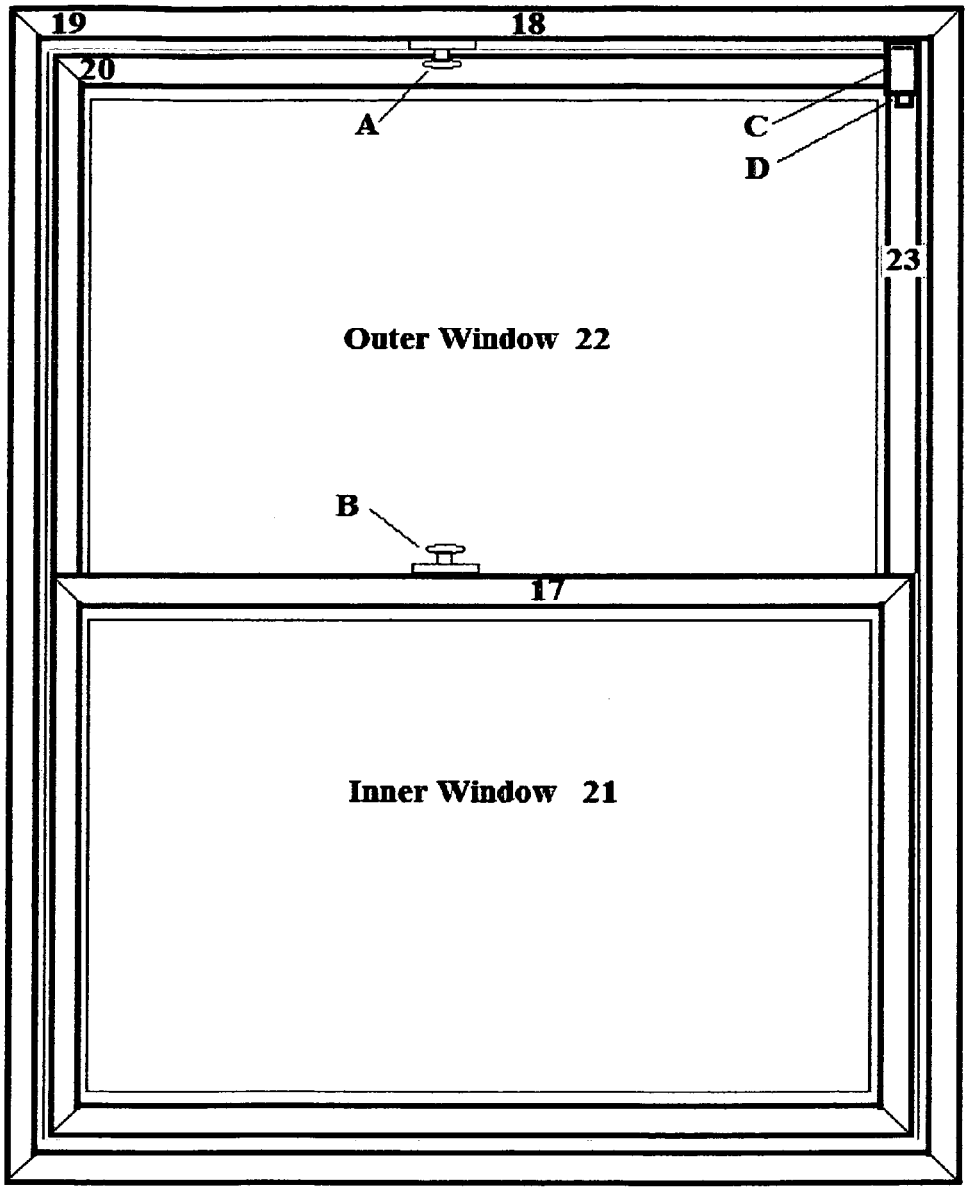
FIG. 4 is a drawing of a double hung window.

FIG. 4 shows a double hung window with identifiers indicating locations of installation of the window lock at locations (A, B) and the secondary window lock at locations (C, D). A mounting base (6) is attached to the inner window frame (17) and the upper sill plate (18). The secondary window latch plate (12) may be installed on the upper sill plate (18) at location (19) as long as the secondary window latch base (13) is attached to the outer window frame (23) at location (20).

I claim:

1. A safety lock system for a single or double hung, side sliding window or sliding glass comprising:

an outer tube having a locking pin;

an inner tube receiving within the outer tube and having a channel connecting a plurality of locking slots;

first and second connectors, each having a top opening and lateral opening, an end of the inner tube is received in the top opening of the first connector and an end of the outer tube is received in the top opening of the second connector;

first and second mounting bases, each mounting base comprising a pin member, the first mounting base is received into the lateral opening of the first connector so that the pin member of the first mounting base is received in the end of the inner tube and the second mounting base is received into the lateral opening of the second connector so that the pin member of the second mounting base is received in the end of the outer tube;

the top opening of the first connector is narrow to prevent the inner tube from rotating and the top opening of the second connector is wide to allow the outer tube to rotate, allowing the locking pin on the outer tube to be guided and positioned in a desired locking slot of the inner tube, telescopically adjusting the outer tube to the inner tube each connector further comprise a pivotal locking member to secure the mounting members in the respective connector and prevent each connector from shifting of the respective base due to vibration or use.

2. The safety lock system described in claim 1, wherein, when the system is used on a window, the system further comprises a window latch plate adapted to be installed on an upper sill plate and a window latch base attached to the window frame, the window latch plate being attached to the window base plate preventing opening of the window.

3. The safety lock system described in claim 1, wherein the plurality of the locking slots has a "T" shaped configuration.

4. The safety lock system described in claim 1, wherein the pivotal locking member in each connector is a pivotal door secured to the respective connector by a magnet or stiff felt pad.

* * * * *